US010105281B1

(12) United States Patent
Costella

(10) Patent No.: US 10,105,281 B1
(45) Date of Patent: Oct. 23, 2018

(54) NEGATIVE PRESSURE VEST

(71) Applicant: TRUDELL MEDICAL INTERNATIONAL, London (CA)

(72) Inventor: Stephen Costella, London (CA)

(73) Assignee: TRUDELL MEDICAL INTERNATIONAL, London, Ontario (CA)

( * ) Notice: Subject to any disclaimer, the term of this patent is extended or adjusted under 35 U.S.C. 154(b) by 532 days.

(21) Appl. No.: 14/740,701

(22) Filed: Jun. 16, 2015

Related U.S. Application Data

(60) Provisional application No. 62/012,773, filed on Jun. 16, 2014.

(51) Int. Cl.
*A61H 9/00* (2006.01)
*A61H 31/02* (2006.01)

(52) U.S. Cl.
CPC ..... *A61H 31/02* (2013.01)

(58) Field of Classification Search
CPC ..... A61H 9/0057
See application file for complete search history.

(56) References Cited

U.S. PATENT DOCUMENTS 3,903,869 A 9/1975 Bancalari
4,815,452 A 3/1989 Hayek
5,101,808 A * 4/1992 Kobayashi ..... A61H 31/02 128/204.25
6,182,658 B1 2/2001 Hayek
6,345,618 B1 2/2002 Hayek
2008/0115786 A1* 5/2008 Sinderby ..... A61H 31/02 128/204.23
2009/0255531 A1* 10/2009 Johnson ..... A61F 5/24 128/99.1

OTHER PUBLICATIONS

Journal of Respiratory Medicine, "Review: Body plesthymography—Its principals and clinical use," Criee, C.P. et al., Elsevier Ltd., dated Feb. 6, 2011, vol. 105, pp. 959-971.

* cited by examiner

*Primary Examiner* — Sundhara Ganesan
(74) *Attorney, Agent, or Firm* — Brinks Gilson & Lione

(57) ABSTRACT

A negative pressure vest includes a housing defining a fixed, minimum interior volume. The housing has a neck opening, a pair of arm openings and a trunk opening. Each of the neck and arm openings includes a sealing member. A one-way check valve communicates between the interior volume and an ambient environment surrounding an exterior of the housing. The one-way check valve is openable at a pressure greater than an ambient atmospheric pressure. A one-way pressure-relief valve communicates between the interior volume and the ambient environment. The one-way intake valve is openable at a predetermined negative pressure. A method of providing negative pressure to the user's thorax is also provided.

24 Claims, 5 Drawing Sheets

NEGATIVE PRESSURE VEST

This application claims the benefit of U.S. Provisional Application Ser. No. 62/012,773, filed Jun. 16, 2014, the entire disclosure of which is hereby incorporated herein by reference.

TECHNICAL FIELD

The embodiments disclosed herein relate generally to a negative pressure vest, and to methods for the use thereof.

BACKGROUND

Chronic obstructive pulmonary disease (COPD) causes an increase in the work of breathing that leads to dyspnea, respiratory muscle fatigue and general discomfort. One therapy for COPD patients is to provide continuous positive airway pressure (CPAP), wherein the patient's airways are maintained at a constant, positive pressure throughout their respiratory cycle. This type of therapy has been shown to effectively relieve hyperinflation and gas trapping in COPD patients thereby decreasing the inspiratory work of breathing. A downside is that CPAP devices may be bulky, which limits the portability of the device and consequently the mobility of the patient. In addition, CPAP devices require a facial interface, such as a mask or other device, which may cause discomfort and lead to poor patient compliance. In addition, CPAP devices require an energy source, whether electrical or pneumatic.

Alternatively, the benefits of CPAP may be achieved by surrounding the thorax of the user with negative pressure. Typically, such devices are configured with bulky external compressors, requiring a power supply, which may limit patient mobility and compliance.

SUMMARY

Briefly stated, in one aspect, one embodiment of a negative pressure vest includes a housing defining a fixed, minimum interior volume. The housing has a neck opening, a pair of arm openings and a trunk opening. Each of the neck and arm openings includes a sealing member. A one-way check valve communicates between the interior volume and an ambient environment surrounding an exterior of the housing. The one-way check valve is openable at a pressure greater than an ambient atmospheric pressure. A one-way pressure-relief valve communicates between the interior volume and the ambient environment. The one-way intake valve is openable at a predetermined negative pressure.

In another aspect, one embodiment of a method of providing negative pressure to a user's thorax includes donning a negative pressure vest by inserting the user's arms through a pair of arm openings formed in a housing, and inserting a user's head through a neck opening formed in the housing with the user's trunk extending through a trunk opening in the housing. The method further includes sealing the housing around the arms and a neck of the user. The housing defines a fixed, minimum interior volume. The method further includes inhaling and thereby increasing a pressure in the interior volume, exhaling and thereby decreasing the pressure in the interior volume, passing air from the interior volume to an ambient environment through a one-way check valve if the pressure is greater than an ambient atmospheric pressure of the ambient environment, and passing air from the ambient environment to the interior volume through a one-way pressure-relief valve if the pressure falls below a predetermined negative pressure.

The various aspects and embodiments provide significant advantages over other CPAP and negative pressure devices. For example, the vest uses the patient's own respiratory motion to generate the desired negative pressure around the thorax. The device is lightweight and portable, and may not require a power source or compressor, thereby increasing the patient's mobility and compliance.

The present embodiments, together with further objects and advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "coupled" means connected to or engaged with, whether directly or indirectly, for example with an intervening member, and does not require the engagement to be fixed or permanent, although it may be fixed or permanent. The phrase "fluid communication," and variants thereof, refers to fluid being able to pass between the components, whether directly or indirectly, for example through one or more additional conduits or components. It should be understood that the use of numerical terms "first," "second," "third," etc., as used herein does not refer to any particular sequence or order of components. It should be understood that the term "user" and "patient" as used herein refers to any user, including pediatric, adolescent or adult humans, and/or animals.

Figure 1:
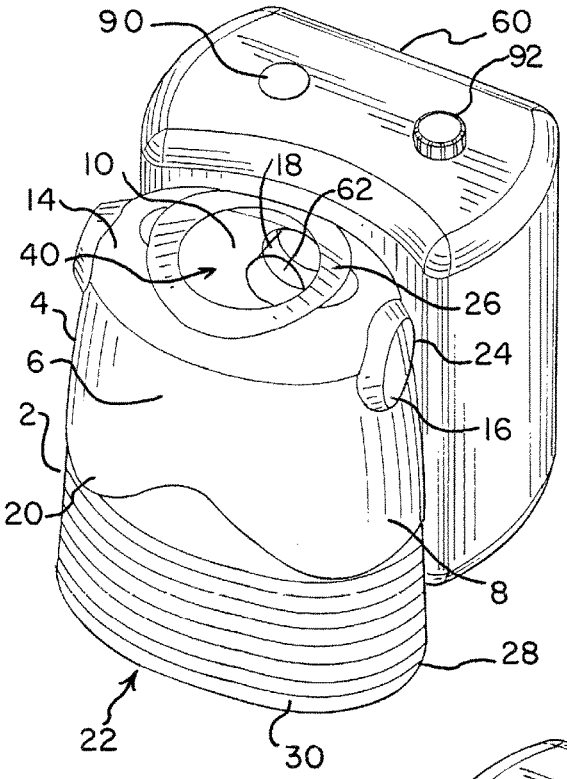
FIG. 1 is a perspective view of one embodiment of a negative pressure vest configured with a volume augmentation vessel.
Figure 4:
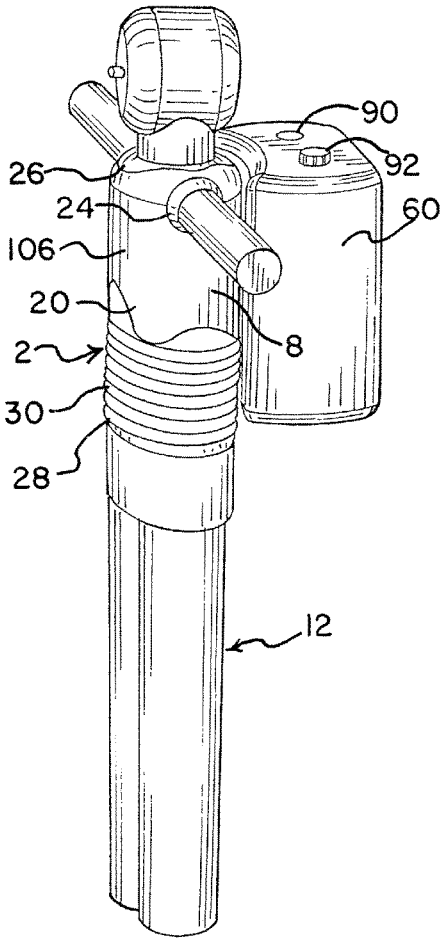
FIG. 4 is a perspective view of the negative pressure vest shown in FIG. 1 applied to a user.

Referring to FIGS. 1-5, 11 and 12, various negative pressure vests 2, 102, 202, 302 are shown as including a housing 4, 104, 204, 304. In one embodiment, a circumferential housing 1, 104, 204, 304 completely encircles the body 12 of the user, and includes a front 6, 106, 216, 316, back 10, 110, 210, 310, side 8, 108, 208, 308 and top 14, 114, 214, 314 portions. It should be understood that the housing, in cross section, may be circular, elliptical, oblong, or polygonal, with the term "circumferential" referring to a closed boundary, and including but not limited to a circular configuration. An arm hole 16, 116, 21, 316 is formed in each of the side portions. A neck opening 18, 118, 218, 318 is formed in the top portion, and a bottom 20, 120, 220, 320 of the housing is generally open, forming a trunk opening 22, 122, 222, 322. Sealing members 24, 124, 224, 324, 216, 126, 226, 326 are secured around the periphery of each of the neck and arm openings. In the embodiment of FIGS. 1 and 4, a sealing member 28, configured as a flexible skirt, extends downwardly from bottom portion of the housing and acts as a waist seal. The skirt has radial support from embedded rings 30 to prevent collapse as negative pressure is generated in the interior volume. The rings 30 are vertically staggered such that the user 12 is free to bend in any direction. The front portion 6 of the housing may be scalloped along a centerline to provide additional flexibility.

Figure 11:
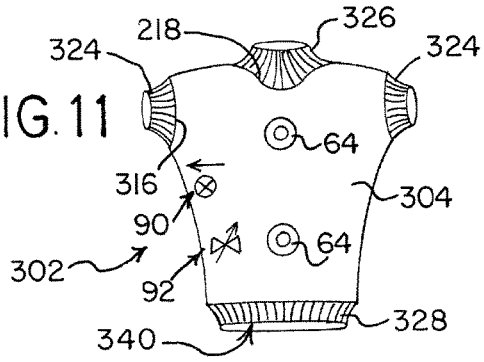
FIG. 11 shows a rear view of one embodiment of a negative pressure vest.

Alternatively, the housing 104, 204, 304 may be completely rigid down so the waistline as shown in the embodiment of FIGS. 2, 3, 5 and 11. As shown in FIG. 11, a trunk sealing member 328 is provided along the bottom of the housing. A trunk sealing member extends around an inner periphery of the housing along a bottom thereof in the embodiments of FIGS. 2 and 5. In some instances, the vest may be worn over garments if constructed of a material, such as a tight-fitting compression shirt, that would preclude leakage. Otherwise, the vest is worn next to the skin so as to promote a seal with the body of the user, with clothing then worn over the vest.

Figure 5:
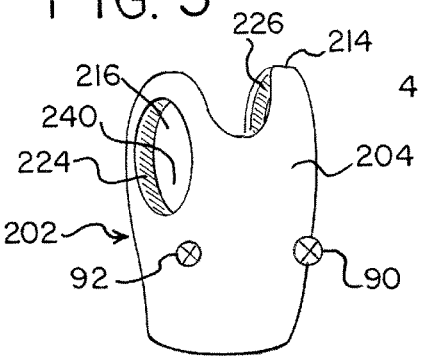
FIG. 5 is a perspective view of another embodiment of a negative pressure vest.

The sealing members may be made of a silicone type material, which provide a hermetic seal as well as anchoring or holding the vest to/on the user. As shown in FIG. 5, the top portion 214 of the housing may be formed by straps defining a deeper neck line. The housing may be formed as a single, integral piece, or may be formed by joining several pieces together. The housing is made of a relatively rigid material that maintains its shape when subjected to a range of operable negative pressures applied to an interior volume thereof. In various embodiments, the housing may be made of plastic, metal, composite, such a fiberglass, stiff rubber, or combinations thereof.

Figure 6A:
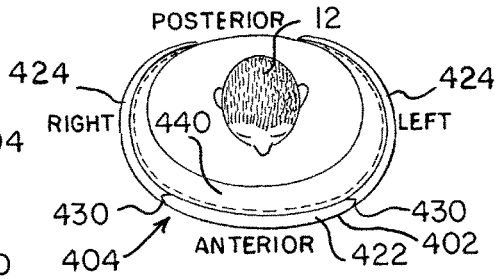
FIGS. 6A-C are top views of an alternative embodiment of a negative pressure vest applied to a user and in first and second configurations.
Figure 6B:
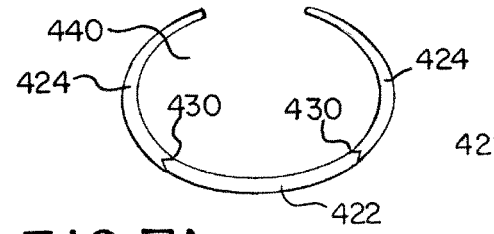
Figure 6C:
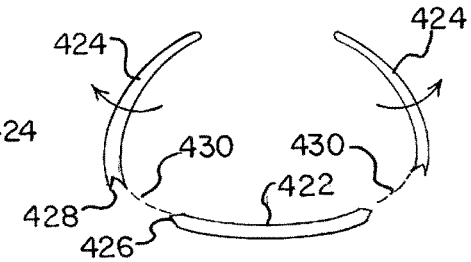

Referring to FIGS. 6A-C, an alternative embodiment of a housing 404 is generally C-shaped in cross-section and is open along a rear thereof. The housing may or may not include a top portion, but may include arm holes, a neck opening and a trunk opening, all configured with sealing members. The housing may be made of a plurality of rigid plastic plates 424, shown as three but may be two or four or more. The term "plate" should be understood to include thin sheetlike materials, whether flat or curved. The plates are coupled together by expansion joints 430. The adjacent edge portions 426, 428 of the plates are fitted together in a first configuration, and may separate in a second configuration, with the expansion joints maintaining a connection between the adjacent plates. The expansion joints may be formed from an elastic, non-breathable material, and/or include various tethers, but maintain a hermetic seal between the adjacent plate members when separated in the second configuration. For example, a larger than normal inhalation may cause the chest wall to contact the interior walls of the vest. If the vest is rigid, it may inhibit the user from breathing in any further. The expansion joints 430 allow further chest expansion during deep breaths. This feature would typically not be activated by a user's chest during normal tidal breathing. The expansion joints 430 create a tensile force tending to pull the plates into the first, engaged configuration.

The housing, whether circumferential or open to the rear, has an interior surface that defines an interior volume 40, 140, 240, 340, 440 when not occupied by a user. The interior volume has a fixed minimum, shown for example in FIGS. 1-5, 6A and 6B, and 11. As previously described, in one embodiment, the interior volume may be increased in use from the fixed, minimum interior volume to an expanded interior volume shown in FIG. 6C. It should be understood that different size housings may be made to accommodate different size users, with the interior volume being fixed for each.

Figure 8A:
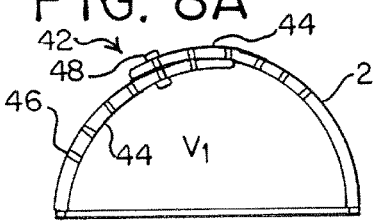
FIGS. 8A and B show one embodiment of a volume adjustment mechanism.
Figure 8B:
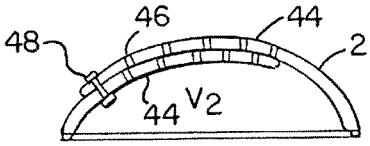

Referring to FIGS. 8A, B and 9A, B, the fixed, minimum volume 40, 140, 240, 340, 440 may be adjusted with an adjustment mechanism 42, 54 or device. In the embodiment of FIGS. 8A and B, one or both of overlapping portions 44 of the housing, whether positioned along the front, side or rear portions of the housing, are configured with a plurality of adjustment devices 46, whether configured as holes, catches, hooks, etc. A connector 48, configured in one embodiment as a pin, connects the adjustment devices 46, such as by extending through aligned openings, to fix the position of the overlapping portions relative to each other. In other embodiments, the connector may be configured as a catch hook or loop that engages a catch, hook or loop on the other of the overlapping portion. The adjustment devices, such as openings, may be self-sealing so as to maintain a hermetic seal between the overlapping portions.

Figure 9A:
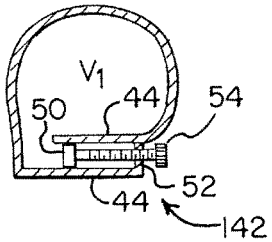
FIGS. 9 A and B show another embodiment of a volume adjustment mechanism.
Figure 9B:
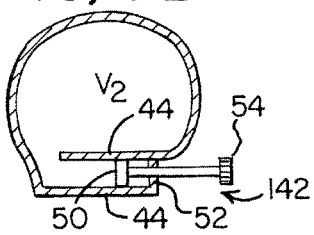

In the embodiment of FIGS. 9A and B, each of the overlapping portions 44 includes a connector block 50, 52. A volume adjustment mechanism 54 is configured as a threaded member that threadably engages one block 52 and is rotatably secured to the other block 50. In operation, the member is rotated such that the overlapping members 44 are moved relative to each other so as to increase or decrease the fixed, minimum interior volume. In this embodiment, the fixed, minimum interior volume is infinitely adjustable. When a desired volume is achieved, the vest is applied to the user. Alternatively, the vest may be applied to a user, with the adjustment mechanism being adjusted to achieve the appropriate interior volume. The overlapping portions may include a gasket or seal therebetween to maintain a hermetic seal.

Figure 2:
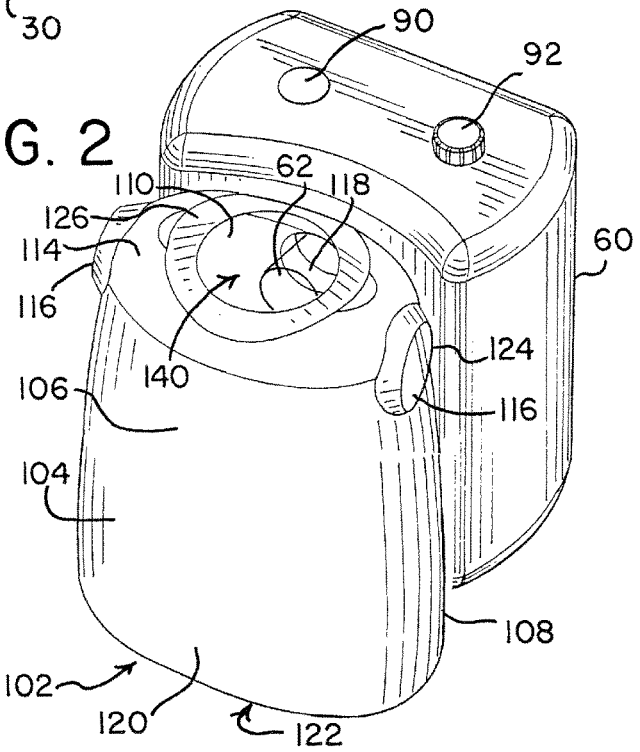
FIG. 2 is a perspective view of another embodiment of a negative pressure vest configured with a volume augmentation vessel.
Figure 3:
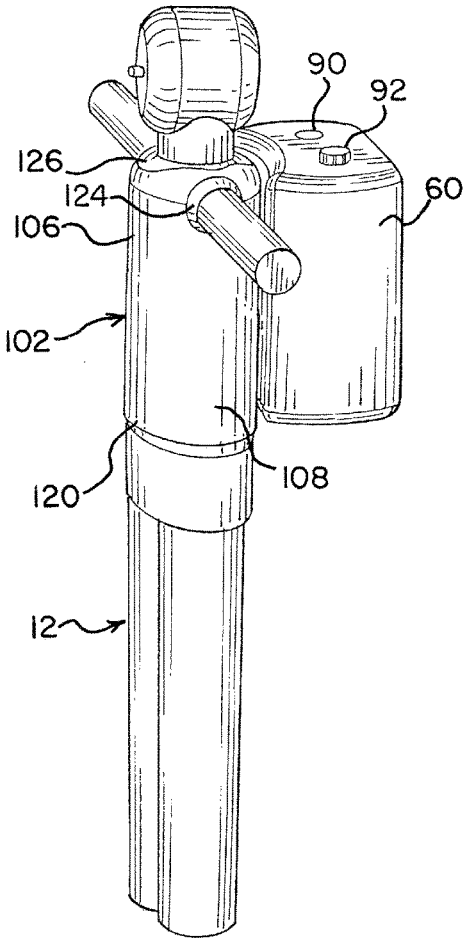
FIG. 3 is a perspective view of the negative pressure vest shown in FIG. 2 applied to a user.
Figure 12:
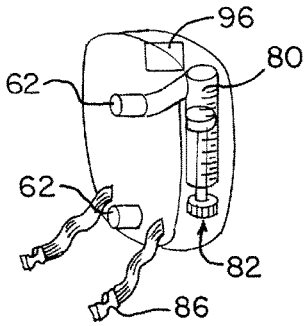
FIG. 12 is a perspective view of one embodiment of a volume augmentation vessel.

Referring to FIGS. 1, 2 and 12, a volume augmentation vessel 60 is shown. The vessel may include one or more insert members or posts 62, that are inserted into corresponding openings or ports 64 provide in the rear portion of the vest (FIGS. 1 and 11). The insert members are hermetically sealed in the ports. One or both of the insert members may be configured as a conduit that is in fluid communication between the interior volume 40 of the vest and an auxiliary interior volume 80 defined by, or carried by, the vessel 60. In one embodiment, the auxiliary interior volume may be adjusted with a volume adjustment member 82, configured in one embodiment as a plunger that moves within a cylinder to increase or decrease the auxiliary interior volume 80. The plunger may be actuated by pushing, pulling or rotation. In other embodiments, the auxiliary interior volume may be varied by inflating or deflating a space-occupying bladder, which is relatively rigid and not affected by the negative pressure applied by the user. The vessel may be locked to the vest with one or more detents or other connectors acting on the insert member. In addition, a strap 86, or belt, may be secured around the user to help support the vessel. The vessel is optional, and when not in use, the ports 64 may be plugged or closed with a cap or cover member 88 as shown in FIG. 11. Ordinarily, for any significant inhalation assist, it is likely the vessel will be required. If the user is being treated only with PEP therapy (positive expiratory pressure), then the vessel would likely not be required.

Referring to 11, the vest includes a one-way check valve 90 communicating between the interior volume 340 of the vest and the ambient environment surrounding an exterior of the housing. The check valve permits a one-way flow of air from the interior volume to the ambient environment if the pressure in the interior volume exceeds the atmospheric pressure of the ambient environment. The check valve 90 may also be located on the vessel 60, which is in fluid communication with the interior volume, as shown in FIG. 1.

The vest also includes a one-way pressure relief valve 92 communicating between the interior volume of the vest and the ambient environment surrounding the exterior of the housing. The one-way pressure relief valve is adjustable. The valve allows outside atmospheric air to enter the interior volume if the pressure falls below a predetermined negative pressure. Magnetic or spring loaded PEEP valves are suitable one-way pressure relief valves. A spring based valve may provide easier control of NEEPv as compared to a magnetic valve. The pressure-relief valve 92 may also be located on the vessel, which is in fluid communication with the interior volume.

In operation, the user 12 dons the vest 2, 102, 202, 302, 402, inserting their arms through the arm openings 16 and their head through the neck opening 18, with their torso extending through the trunk opening 22. If appropriate, the interior volume may be adjusted using the volume adjustment mechanism 42, 54. In addition, if it is determined that additional interior volume is needed, a vessel 60 may be secured to the vest, either before or after it is donned by the user. For example, and referring to FIG. 13, if the interior volume is too small, then the inhalation assist may drop to zero very quickly. Conversely, if the vest interior volume is too large, then the targeted negative end expiratory pressure of the vest (NEEPv) is never achieved.

Figure 7A:
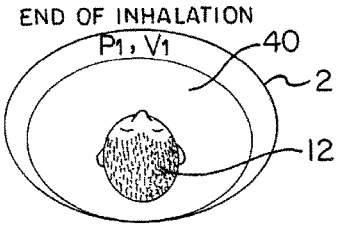
FIGS. 7A and B shown negative pressure vest applied to a user at the end of inhalation and exhalation respectively.
Figure 7B:
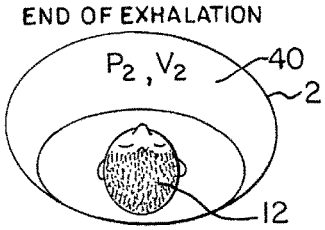
Figure 13:
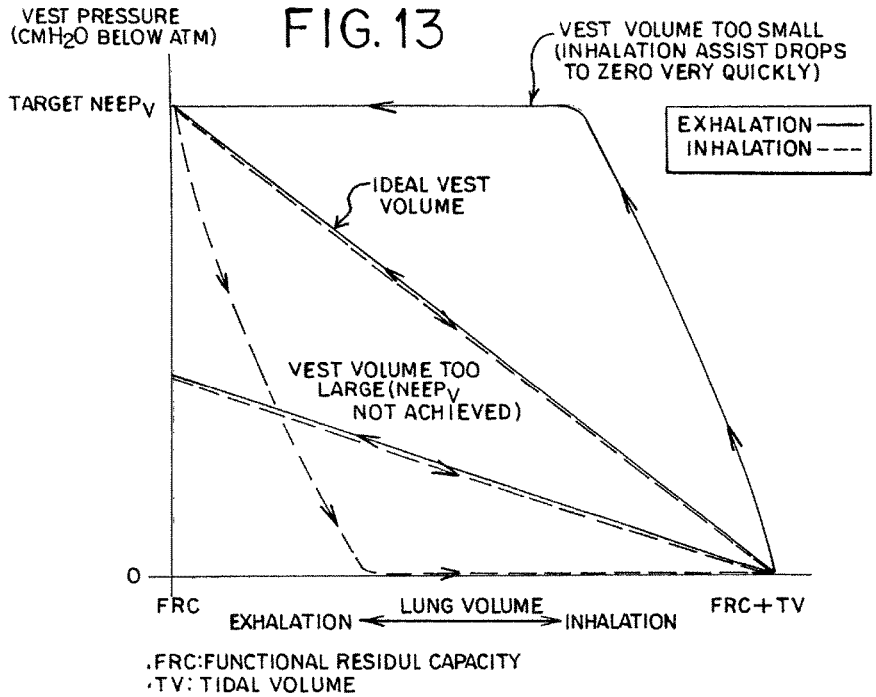
FIG. 13 is a graph showing vest pressure v. lung volume.

The vest uses the negative pressure surrounding the thorax and abdomen, collectively the trunk, to provide similar benefits as CPAP. The vest functions using Boyle's law, which states that for isothermal gas expansion, the product of the initial absolute pressure (P1) and volume (V1) of a closed system will be equal to the product of the system's final absolute pressure (P2) and volume (V2). That is P1*V1=P2*V2. In the present embodiments, the interior volume of the vest is fixed, but the user's trunk, including the thorax, changes volume as the user inhales and exhales. As the user exhales inside the fixed interior volume, his/her chest contracts, thereby increasing the volume of air between the user's body and the interior surface of the housing. This increase in volume results in a decrease in pressure of the closed system, which reaches a minimum pressure (i.e., most negative) at the end of exhalation (FIGS. 7B, 13), providing a similar benefit as positive end expiratory pressure (PEEP). As the user begins his/her inhalation, this negative pressure helps to expand the thorax, or chest, thereby decreasing the inspiratory work of breathing. The inspiratory assistance decreases according to Boyle's law such that at the end of the inhalation cycle (FIG. 7A), the user is receiving minimal assistance as shown in FIG. 13. Referring to the embodiment of FIG. 6A-C, the interior volume of the vest may increase in response to a particularly large inhalation, but with the vest returning to a normal, fixed minimum interior volume during exhalation. In any of the embodiments, the operation of the vest ensures that the maximum pressure support will occur near the end of exhalation when the airways are most vulnerable to collapse. The inspiratory pressure support is maximized at the commencement of inhalation in order to offset any intrinsic positive end expiratory pressure from the prior exhalation.

If the pressure in the vest were ever to rise above atmospheric pressure, the check valve 90 opens, allowing air to escape and the pressure to equalize with the atmospheric pressure. Conversely, if the negative pressure is less than a predetermined negative pressure, which may be adjusted by the user or caregiver, the pressure relief valve 92 opens to allow air to enter the vest until the desired negative pressure is achieved.

Normally, the P2 pressure at the end of exhalation would be predetermined, for example by being prescribed by a physician or other caregiver. In turn, the patient's tidal volume (TV) is then used to calculate V2=V1+TV. The initial vest volume V1 that will maintain negative vest pressure throughout inhalation while achieving the desired NEEPv, assuming no leakage and isothermal gas compression, may be calculated as follows:

$$(P_{atm})V1=\text{NEEPv}(V1+TV)$$

$$(P_{atm}/\text{NEEPv})V1-V1=TV$$

$$V1=\text{NEEPv}(TV)/(P_{atm}-\text{NEEPv})$$

Figure 14:
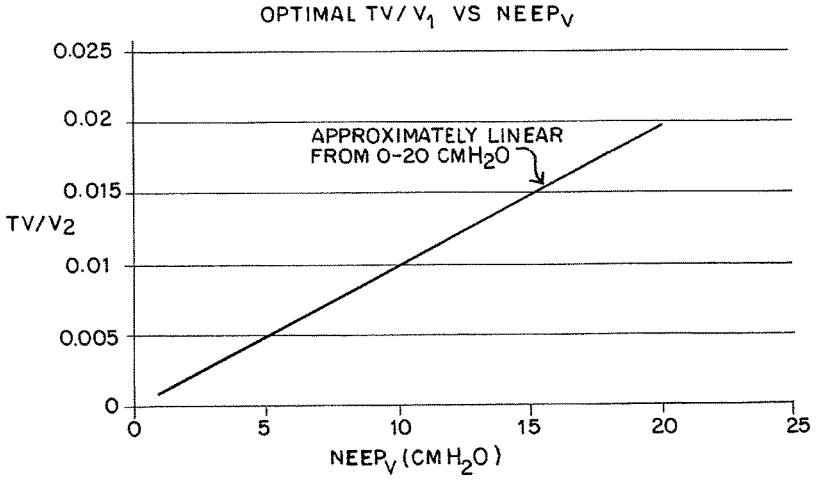
FIG. 14 is a graph of TV/V1 v. NEEPv

Put another way:

$TV/V1=(P_{atm}-\text{NEEPv})/\text{NEEPv}$, which is shown graphically in FIG. 14.

To the extent leakage is not contained, a small compressor 96 may be incorporated and communicate with the interior volume to augment the natural assist generated by the patient's own respiratory motion.

In an exemplary embodiment, the negative pressure relief valve maintains vest pressure at P2=−10cm$H_2O$=100345 Pa at the end of exhalation. Atmospheric pressure P1=101325 Pa. f V1=0.005 m^3 (5 L) and the change in volume V2-V1=200 mL (tidal volume), then V2=0.0052 m^3 (5.2 L). Upon inhalation, there will be negative vest pressure for approximately 50 mL of the 200 mL breath, or about 25%.

This means that after 50 ml, the vest pressure will approximate atmospheric pressure. As such the assistive volume will need to be increased, either by increasing the fixed, minimum interior volume with an adjustment mechanism, or by providing an auxiliary interior volume as described previously. In one embodiment P2=−5cm$H_2O$, and P1=−1cm$H_2O$.

Figure 10:
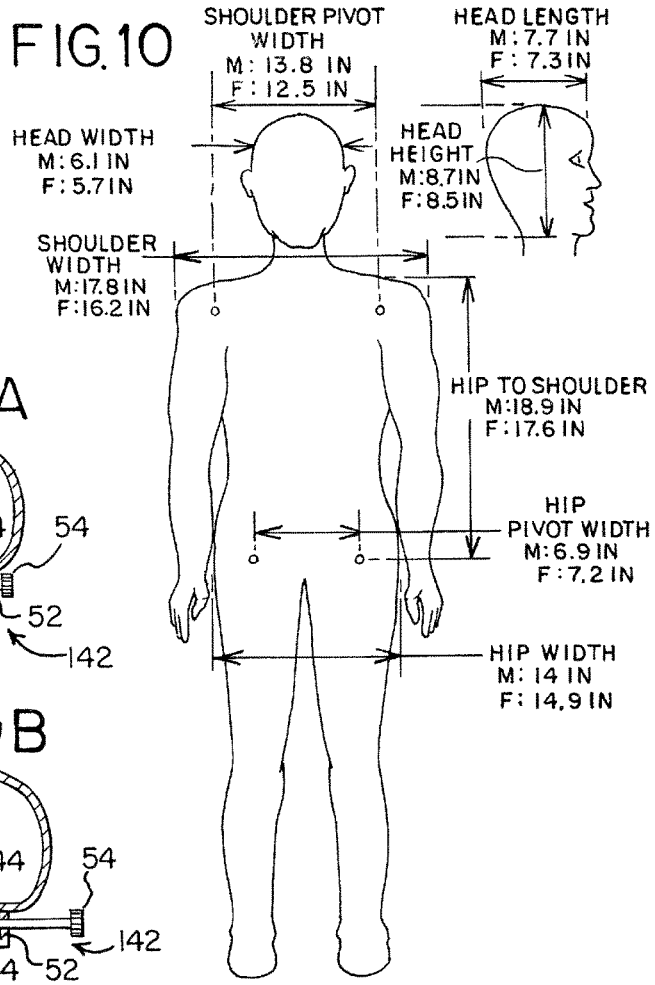
FIG. 10 shows a patient.

Referring to FIG. 10, a $50^{th}$ percentile US adult is shown, with various dimensions. The dimensions in FIG. 10 may be used for a "one-size-fits-all" vest. Alternatively, dimensions for various percentiles of US adult sizes may be determined to provide different sizes of vests (S, M, L, etc.).

The fixed, minimum interior volume may vary depending on the size of the user, but may be in the range of 15 L to 60 L greater than the patient's trunk volume. Volume adjustments may be incrementally increased or decreased, for example by tens of liters. For example, an individual with a 500 mL tidal volume and desired NEEPv of 10 cmH2O would require a vest volume of around 50 L. If that same individual needed a NEEPv of 15 cmH2O, as prescribed for example by the user's physician, the vest volume may be reduced to around 34 L.

According to the Center for Disease Control and Prevention in the US, average waist circumference (trunk opening) for men over 50 is around 105 cm in the US, average mid-arm circumference (arm openings) is around 34 cm, meaning that a suitable trunk opening may have a diameter of around 33.5 cm and the mid-arm around 10.8 cm. A suitable neck opening may have a diameter of 10-15 cm.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A negative pressure vest comprising:

a housing defining a fixed, minimum interior volume, said housing having a neck opening, a pair of arm openings and a trunk opening, each of said neck and arm openings comprising a sealing member;

a one-way check valve communicating between said interior volume and an ambient environment surrounding an exterior of said housing, said one-way check valve openable at a pressure greater than an ambient atmospheric pressure; and a one-way pressure-relief valve communicating between said interior volume and said ambient environment, said one-way pressure-relief valve openable at a predetermined negative pressure.

2. The negative pressure vest of claim 1 wherein said check valve and said pressure-relief valve are positioned in said housing.

3. The negative pressure vest of claim 1 wherein said housing comprises a rigid shell.

4. The negative pressure vest of claim 3 wherein said rigid shell comprises a plurality of rigid plastic plates coupled together with expansion joints, wherein said rigid plastic plates are moveable between a first position defining said minimum interior volume and a second position wherein said plurality of rigid plastic plates and said expansion joints define a second interior volume greater than said minimum interior volume.

5. The negative pressure vest of claim 1 further comprising a volume augmentation vessel in fluid communication with said interior volume, said volume augmentation vessel defining an auxiliary interior volume, wherein said interior volume and said auxiliary interior volume are in fluid communication and maintained at the same pressure.

6. The negative pressure vest of claim 5 wherein said check valve and said pressure-relief valve are located on said volume augmentation vessel.

7. The negative pressure vest of claim 5 wherein said volume augmentation vessel comprises a volume adjustment member moveable between a plurality of positions, wherein said auxiliary interior volume is changeable between a plurality of auxiliary interior volumes corresponding to said plurality of positions.

8. The negative pressure vest of claim 1 further comprising a compressor communicating with said interior volume.

9. The negative pressure vest of claim 1 further comprising a sealing member formed around said trunk opening.

10. The negative pressure vest of claim 1 further comprising a volume adjustment mechanism connected to said housing, said volume adjustment member moveable between a plurality of positions, wherein said interior volume is changeable between a plurality of interior volumes corresponding to said plurality of positions.

11. A method of providing negative pressure to a user's thorax comprising:

donning a negative pressure vest by inserting the user's arms through a pair of arm openings formed in a housing, and inserting a user's head through a neck opening formed in said housing such that a user's trunk extends through a trunk opening in said housing, and sealing the housing around said arms and a neck of said user, wherein said housing defines a fixed, minimum interior volume;

inhaling and thereby decreasing a volume of air between the user's trunk and the interior of the housing and increasing a pressure in said interior volume;

exhaling and thereby increasing a volume of air between the user's trunk and the interior of the housing and decreasing said pressure in said interior volume;

passing air from said interior volume to an ambient environment through a one-way check valve if said pressure is greater than an ambient atmospheric pressure of said ambient environment; and passing air from said ambient environment to said interior volume through a one-way pressure-relief valve if said pressure falls below a predetermined negative pressure.

12. The method of claim 11 wherein said check valve and said pressure-relief valve are positioned in said housing.

13. The method of claim 11 wherein said housing comprises a rigid shell.

14. The method of claim 13 wherein said rigid shell comprises a plurality of rigid plastic plates coupled together with expansion joints, wherein said inhaling comprises moving said rigid plastic plates between a first position defining said minimum interior volume and a second position wherein said plurality of rigid plastic plates and said expansion joints define a second interior volume greater than said minimum interior volume.

15. The method of claim 11 further comprising coupling a volume augmentation vessel in fluid communication with said interior volume, wherein said volume augmentation vessel defines an auxiliary interior volume, and further comprising maintaining said interior volume and said auxiliary interior volume at the same pressure.

16. The method of claim 15 wherein said check valve and said pressure-relief valve are located on said volume augmentation vessel.

17. The method of claim 15 further comprising adjusting said auxiliary interior volume of said volume augmentation vessel with a volume adjustment member.

18. The method of claim 11 further comprising coupling a compressor in fluid communication with said interior volume.

19. The method of claim 11 further comprising sealing said housing to said torso of said using at said trunk opening.

20. The method of claim 11 further comprising adjusting said minimum interior volume of said housing with a volume adjustment member.

21. The negative pressure vest of claim 1 wherein said interior volume is free of any connection to an external vacuum generator.

22. The negative pressure vest of claim 1 wherein said trunk opening is spaced from said neck opening such that said housing is shaped to surround an abdomen of the user.

23. The method of claim 11 wherein said decreasing said pressure in said interior volume is accomplished free of applying any external vacuum to said interior volume.

24. The method of claim 11 wherein said inserting said user's head through said neck opening formed in said housing such that said user's trunk extends through a trunk opening in said housing further comprises surrounding an abdomen of said user with said housing.

* * * * *